US005743345A

United States Patent [19]

Hollar et al.

[11] Patent Number: 5,743,345

[45] Date of Patent: Apr. 28, 1998

[54] DRILL BIT FOR REVERSE DRILLING

[75] Inventors: Charles D. Hollar, Roanoke; Stuart A. Connell, Buchanan, both of Va.

[73] Assignee: Ingersoll-Rand Company, Woodcliff Lake, N.J.

[21] Appl. No.: 688,584

[22] Filed: Jul. 30, 1996

Related U.S. Application Data

[60] Provisional application No. 60/017,574 May 16, 1996.

[51] Int. Cl.[6] ..... E12B 10/00

[52] U.S. Cl. ..... 175/401; 175/415; 175/416

[58] Field of Search ..... 175/401, 415, 175/426, 417, 425

[56] References Cited

U.S. PATENT DOCUMENTS

| | | | |
|---|---|---|---|
| 3,915,246 | 10/1975 | Sheshtawy | 175/426 X |
| 4,091,884 | 5/1978 | Thomas | 175/426 |
| 4,986,375 | 1/1991 | Maher | 175/401 X |
| 5,074,367 | 12/1991 | Estes | 175/426 X |
| 5,090,491 | 2/1992 | Tibbits et al. | 175/426 |

*Primary Examiner*—Roger J. Schoeppel

*Attorney, Agent, or Firm*—John J. Selko

[57] ABSTRACT

A drill bit for reverse drilling in a drill hole being produced by a percussive, fluid-actuated drill includes an elongated drill bit body having a bore extending there through for transmission of a fluid, the body terminating in a head end portion and a shank end portion. Abrasive resistant drilling buttons are arrayed on both the head end portion and the shank end portion to resist abrasion by the material being drilled, during either forward or reverse drilling.

5 Claims, 2 Drawing Sheets

DRILL BIT FOR REVERSE DRILLING

BACKGROUND OF THE INVENTION

This Application claims the benefit under Title 35, U.S.C. §119(e) of U.S. Provisional application serial No. 60/017,574 filed May 16, 1996.

This invention relates generally to drill bits, and more particularly to drill bits for use in fluid actuated, percussive, down the hole drilling devices. In construction and mining applications, holes must be drilled in many types of materials, using percussive drilling devices. Percussive drilling means the top hammer is rotating while generating impact waves that travel down through the drill string to perform work on the formation being drilled. Depending upon the formation being drilled, loose or broken debris may fall into the drill hole behind the drill bit and cause difficulty in removing the drill bit. A reverse percussive drilling technique is used to retract the bit, as is well known. However, in abrasive formations, wear is excessive on the back end of the retractable bit.

The foregoing illustrates limitations known to exist in present down hole drill bits. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a drill bit for reverse drilling in a drill hole being produced by a percussive, fluid-actuated drill comprising: an elongated body having a body centerline axis extending axially therealong; a bore extending through said body, for passing a fluid therethrough; said body terminating in a shank end portion and a head end portion; connection means on said shank end portion for removably connecting to a drill string component; said head end portion having a plurality of wear resistant drilling buttons thereon; and said shank end portion having a plurality of wear resistant drilling buttons thereon.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
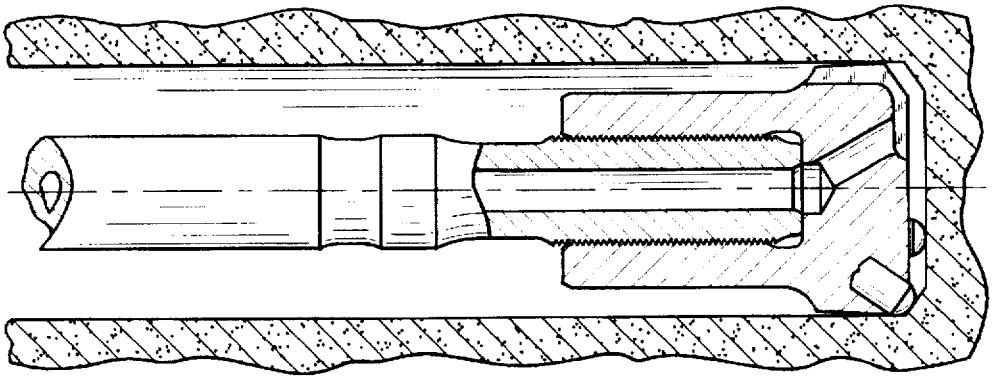
FIG. 1 (PRIOR ART)
FIG. 1 is a schematic, partially cross sectional view of a prior art drill bit and rod connection.
Figure 2:
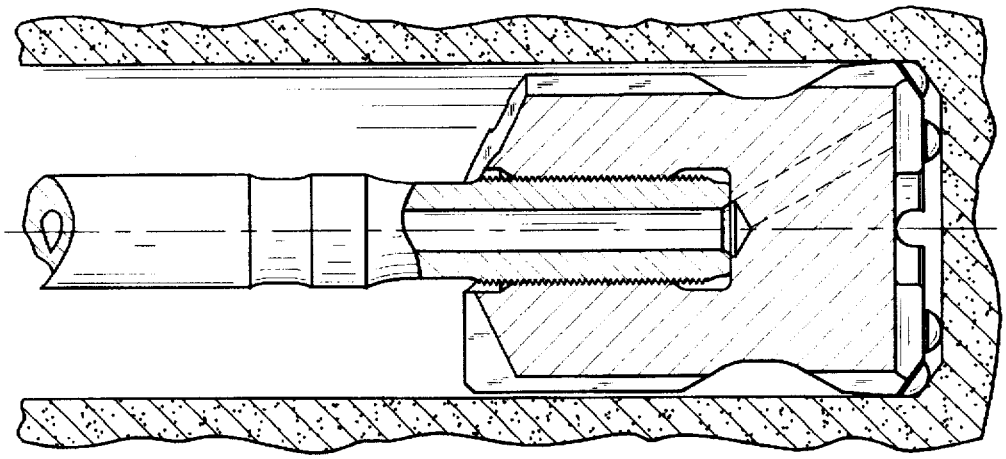
FIG. 2 (PRIOR ART)
FIG. 2 is a schematic, partially cross sectional view of a prior art retractable drill bit.
Figure 3:
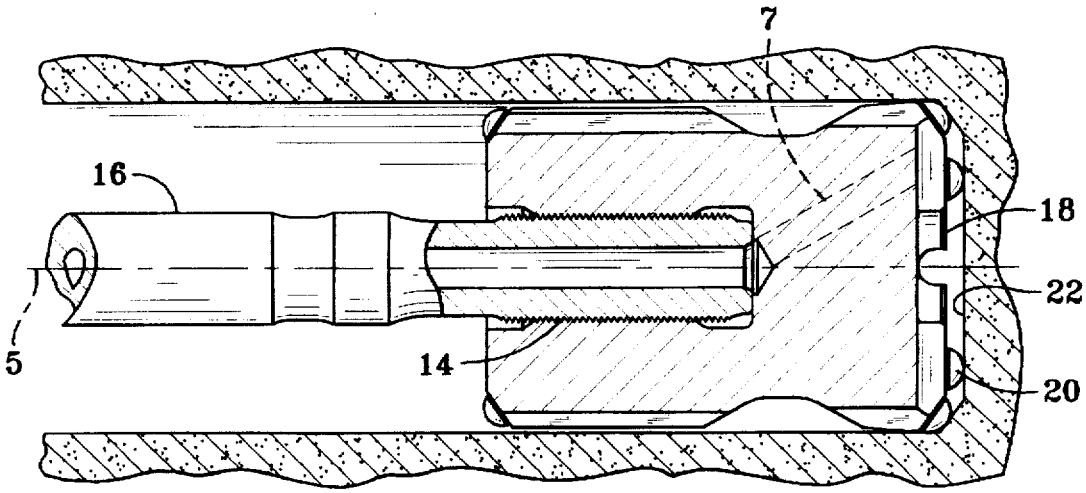
FIG. 3 is a schematic, partially cross sectional view of a reverse drilling bit of the invention.
Figure 4:
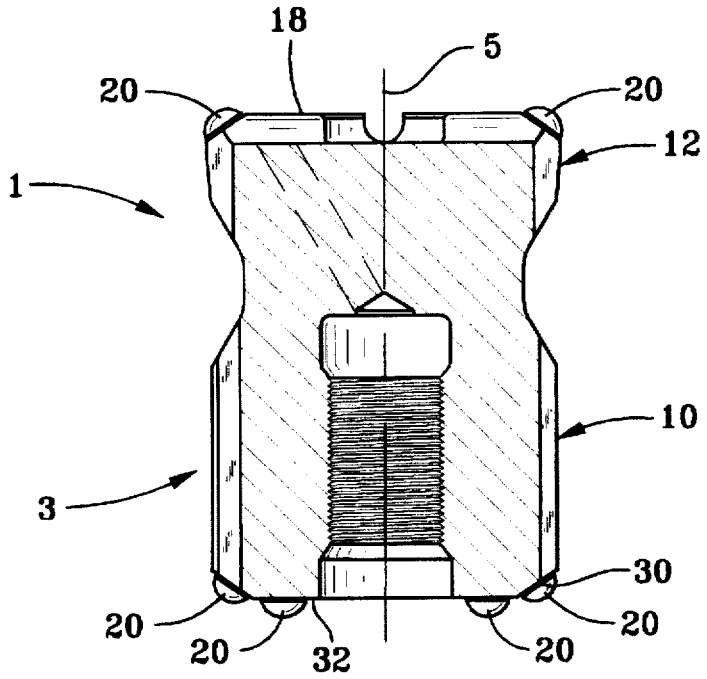
FIG. 4 is a view of the bit of the invention similar to FIG. 3.
Figure 5:
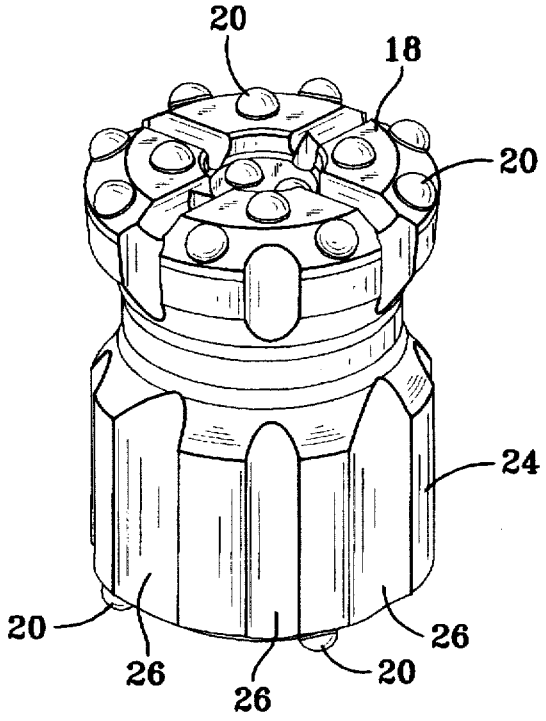
FIG. 5 is a perspective, schematic view of the bit of the invention.

Referring to FIGS. 3–5, the bit of the invention, shown generally as 1, includes an elongated body 3 having a centerline axis 5 extending axially therealong. A bore 7 extends through body 3 for passing a fluid therethrough, as is conventional. Body 3 terminates in a shank end portion 10 and a head end portion 12. Connecting means 14 on shank end portion 10 is for removably connecting drill bit to an drill string component, as is well known. Means 14 forms a female threaded portion for receiving therein and threadably connecting to a male threaded member 16 of an adjoining drill string component.

Head end portion 12 forms a working face 18 having mounted therein a plurality of abrasion resistant drilling buttons 20. Working face 18 is oriented to position drilling buttons 20 in a first outwardly facing direction that corresponds to a drill hole bottom 22. Buttons 20 are arrayed on working face 18 in a conventional pattern.

Outer surface 24 of body 3 contains a plurality of spaced apart undercut portions 26, known as scallops, extending axially along body 3 to provide flow passageways for flow therethrough of drill hole debris.

Shank end portion 10 terminates in an annular distal surface 30 outwardly facing and angled with respect to the centerline axis 5. Surface 30 slopes in a direction toward working face 18. Drilling buttons 20 are arrayed around axis 5 on surface 30, whereby, when said bit is withdrawn upwardly from a drill hole, shank end drilling buttons 20 will cut through drill hole debris that may be trapped there above.

An alternative mode is for distal surface 32 to be oriented in a direction perpendicular to axis 5 and facing in a direction oppositely from working face 18. Buttons 20 can be arrayed on around axis 5 on distal surface 32 and or on both surfaces 30 and 32.

Having described the invention, what is claimed is:

1. A drill bit for reverse drilling in a drill hole being produced by a percussive, fluid-actuated drill comprising:

(a) an elongated body having a body centerline axis extending axially therealong;

(b) a bore extending through said body, for passing a fluid therethrough;

(c) said body terminating in a shank end portion and a head end portion;

(e) connection means on said shank end portion for removably connecting to a first drill string component;

(f) said head end portion having a plurality of wear resistant drilling buttons thereon;

(g) said shank end portion having a plurality of wear resistant drilling buttons thereon; and (h) said body having an outer surface containing a plurality of spaced apart undercut portions extending axially along said body, said undercut portions being substantially smooth and without obstructions therein, to provide flow passageways for unimpeded flow therealong of drill hole debris, when said bit is moved downwardly or upwardly in a drill hole.

2. The drill bit of claim 1 wherein said head end portion forms a working face oriented to position said drilling buttons in a first outwardly facing direction.

3. The drill bit of claim 2 wherein said connection means on said shank end portion forms a female threaded portion for receiving therein and threadably connecting to a male threaded member of an adjoining drill string component.

4. The drill bit of claim 1 wherein said shank end portion terminates in an annular distal surface, said annular distal surface oriented in a second direction facing oppositely from said working face, said drilling buttons being spaced apart from each other and arrayed around said annular distal surface, whereby, when said bit is withdrawn upwardly from a drill hole, said shank drilling buttons will cut through drill hole debris that may be trapped there above and drill hole debris will flow unimpeded downwardly along said smooth undercut portions of said body.

5. The drill bit of claim 1 wherein said shank end portion terminates in an annular distal surface wherein said annular distal surface forms an outwardly facing surface angled with respect to the centerline axis, said annular distal surface sloping in a direction toward said working face, said drilling buttons being arrayed around said annular distal surface, whereby, when said bit is withdrawn upwardly from a drill hole, said shank end drilling buttons will cut through drill hole debris that may be trapped there above and drill hole debris will flow unimpeded downwardly along said smooth undercut portions of said body.

* * * * *